US007926310B2

(12) United States Patent
Yoo et al.

(10) Patent No.: US 7,926,310 B2
(45) **Date of Patent: *Apr. 19, 2011**

(54) FOREIGN MATERIALS FILTERING APPARATUS AND WASHING MACHINE HAVING THE SAME

(75) Inventors: Sang-Hee Yoo, Gyeongsangnam-Do (KR); Jong-Deuk Bae, Gyeongsangnam-Do (KR); Bo-Young Chang, Gyeongsangnam-Do (KR); Young-Bae Park, Gyeongsangnam-Do (KR); Ji-Maeng Kim, Gyeongsangnam-Do (KR); Soo-Jin Jung, Gyeongsangnam-Do (KR); Ae-Na Jo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 371 days.

This patent is subject to a terminal disclaimer.

(21) Appl. No.: 12/041,935

(22) Filed: Mar. 4, 2008

(65) Prior Publication Data

US 2008/0216520 A1 Sep. 11, 2008

(30) Foreign Application Priority Data

Mar. 6, 2007 (KR) ..... 10-2007-0022173

(51) Int. Cl.
*D06F 39/10* (2006.01)

(52) U.S. Cl. ..... 68/18 F; 134/111

(58) Field of Classification Search ..... 68/18 F; 134/111

See application file for complete search history.

(56) References Cited

U.S. PATENT DOCUMENTS

| | | | | |
|---|---|---|---|---|
| 2,413,954 | A | 1/1947 | Conterman | |
| 2,586,508 | A | 1/1952 | Brotman | |
| 2,936,604 | A * | 5/1960 | Glendening | 68/18 F |
| 2,939,305 | A * | 6/1960 | Snyder et al. | 68/18 F |
| 2,971,362 | A | 2/1961 | Olding | |
| 3,027,742 | A | 4/1962 | Nowicki | |
| 3,040,552 | A * | 6/1962 | Platt et al. | 68/18 F |
| 3,240,345 | A * | 3/1966 | Butler et al. | 210/435 |
| 3,727,435 | A | 4/1973 | Menk | |
| 3,769,818 | A | 11/1973 | Smith | |
| 3,805,404 | A | 4/1974 | Gould | |
| 3,836,001 | A | 9/1974 | Heldreth | |
| 3,891,548 | A | 6/1975 | Marcussen | |
| 3,896,641 | A | 7/1975 | Worst | |
| 3,910,076 | A | 10/1975 | Ruble | |

(Continued)

FOREIGN PATENT DOCUMENTS

DE 30 10 182 A1 10/1981

(Continued)

OTHER PUBLICATIONS

European Patent Office 0 735 179 Oct. 1996.*

*Primary Examiner* — Frankie L Stinson

(74) *Attorney, Agent, or Firm* — Birch, Stewart, Kolasch & Birch, LLP

(57) ABSTRACT

Disclosed are a foreign materials filtering apparatus and a washing machine having the same. Since a filter cover unit and a filter unit are integrally modularized with each other, a user can separate or mount the filter unit from/to a washing water circulating duct by separating or mounting the filter cover unit from/to the washing water circulating duct. Accordingly, the foreign materials filtering apparatus can be easily detachably mounted at the washing water circulating duct.

14 Claims, 8 Drawing Sheets

U.S. PATENT DOCUMENTS

| | | | | | |
|---|---|---|---|---|---|
| 3,977,219 | A | | 8/1976 | Bochan | |
| 4,081,975 | A | | 4/1978 | Wortham et al. | |
| 4,417,457 | A | | 11/1983 | Brenner | |
| 4,566,970 | A | | 1/1986 | Piai et al. | |
| 4,622,142 | A | | 11/1986 | Teranishi | |
| 4,833,900 | A | | 5/1989 | Babuin et al. | |
| 5,018,372 | A | | 5/1991 | Altnau, Sr. | |
| 5,078,862 | A | | 1/1992 | Justice | |
| 5,353,612 | A | | 10/1994 | Noguchi et al. | |
| 5,437,789 | A | | 8/1995 | Sabo et al. | |
| 5,509,283 | A | | 4/1996 | Lee et al. | |
| 5,618,419 | A | * | 4/1997 | Fuerst | 210/238 |
| 5,829,275 | A | | 11/1998 | Babuin et al. | |
| 5,849,182 | A | * | 12/1998 | Shin | 210/167.01 |
| 5,858,220 | A | | 1/1999 | Shin | |
| 5,863,423 | A | | 1/1999 | Shin et al. | |
| 5,931,027 | A | | 8/1999 | Shin | |
| 5,989,418 | A | * | 11/1999 | Shin | 210/167.01 |
| 6,076,378 | A | | 6/2000 | Shin | |
| 6,841,058 | B2 | | 1/2005 | Culvey et al. | |
| 7,267,289 | B2 | | 9/2007 | Lyons | |
| 7,412,853 | B2 | | 8/2008 | Hong et al. | |
| 2001/0010165 | A1 | | 8/2001 | Kubota et al. | |
| 2004/0159130 | A1 | | 8/2004 | Lee | |
| 2005/0000920 | A1 | | 1/2005 | Smolley | |
| 2005/0132759 | A1 | | 6/2005 | Guinibert et al. | |
| 2005/0246843 | A1 | | 11/2005 | Song et al. | |
| 2006/0075790 | A1 | | 4/2006 | Jeon et al. | |
| 2006/0096335 | A1 | | 5/2006 | Park et al. | |
| 2006/0123854 | A1 | | 6/2006 | Hong et al. | |
| 2006/0185403 | A1 | | 8/2006 | Ikemizu et al. | |
| 2008/0141554 | A1 | | 6/2008 | Bae et al. | |
| 2008/0141734 | A1 | | 6/2008 | Son et al. | |
| 2008/0216518 | A1 | | 9/2008 | Yoo et al. | |
| 2008/0216519 | A1 | | 9/2008 | Yoo et al. | |
| 2008/0216520 | A1 | | 9/2008 | Yoo et al. | |
| 2008/0216522 | A1 | | 9/2008 | Yoo et al. | |
| 2008/0216523 | A1 | | 9/2008 | Yoo et al. | |
| 2008/0217243 | A1 | | 9/2008 | Yoo et al. | |
| 2008/0276659 | A1 | | 11/2008 | Bae et al. | |
| 2008/0276661 | A1 | | 11/2008 | Bae et al. | |
| 2008/0302138 | A1 | | 12/2008 | Bae et al. | |
| 2008/0313922 | A1 | | 12/2008 | Bae et al. | |
| 2009/0078007 | A1 | | 3/2009 | Bae et al. | |
| 2009/0100882 | A1 | | 4/2009 | Bae et al. | |
| 2009/0113745 | A1 | | 5/2009 | Choi et al. | |
| 2009/0120140 | A1 | | 5/2009 | Choi et al. | |

FOREIGN PATENT DOCUMENTS

| | | | | |
|---|---|---|---|---|
| EP | 0 735 179 | A1 | | 10/1996 |
| JP | 02-005998 | | * | 1/1990 |
| JP | 02-114993 | | * | 4/1990 |
| JP | 6-319895 | A | | 11/1994 |
| JP | 08-323096 | | * | 12/1996 |
| JP | 09-299685 | | * | 11/1997 |
| JP | 10-000293 | | * | 1/1998 |
| JP | 11-207091 | | * | 8/1998 |
| JP | 11-208901 | | * | 8/1999 |
| JP | 2000-354697 | | * | 12/2000 |
| KR | 10-2001-0073573 | A | | 8/2001 |
| KR | 10-2002-0045381 | A | | 6/2002 |
| WO | WO 2005/118940 | A1 | | 12/2005 |

* cited by examiner

FOREIGN MATERIALS FILTERING APPARATUS AND WASHING MACHINE HAVING THE SAME

RELATED APPLICATION

The present invention relates to subject matter contained in priority Korean Application No. 10-2007-0022173, filed on Mar. 6, 2007, which is herein expressly incorporated by reference in its entirety.

BACKGROUND OF THE INVENTION

1. Field of the Invention

The present invention relates to a washing machine, and more particularly to a foreign materials filtering apparatus for filtering foreign materials such as nap floating in a washing tub, and a washing machine having the same.

2. Description of the Background Art

Generally, a washing machine serves to remove each kind of foreign materials attached to laundry such as clothes and bedclothes by a softening operation using detergents, by a frictional operation using a washing current according to rotation of a pulsator, and by an impact applied to laundry from the pulsator, etc.

The washing machine comprises a cabinet that forms the appearance; a reservoir received in the cabinet; a washing tub received in the reservoir, and rotated at the time of a washing or dehydrating process; a motor installed at a bottom surface of the reservoir, for rotating a pulsator and the washing tub; and a clutch for determining a transmission direction of a driving force from the motor, such that both the pulsator and the washing tub rotate at the time of a washing operation, and only the washing tub rotates at the time of a dehydrating operation. The washing machine further comprises a net filter installed at an inner side of the washing tub, for filtering foreign materials such as nap separated from laundry during a washing operation.

The operation of the net filter has been described in Korean Laid-Open Publication No. 2001-73573 or 2002-45381. More concretely, as a pulsator rotates, washing water collected at a lower end of the pulsator rises to an upper side of a washing tub along a flow passage formed between an inner wall and an outer wall of the washing tub. Then, the risen washing water is re-introduced into the washing tub via a mesh of a net filter. Here, foreign materials of the washing water does not pass through the mesh thus to be filtered.

However, the conventional net filter has the following problems.

First, the net filter has to be pulled out of or pushed into a net filter mounting groove with being held by a user's hand so as to be separated from or coupled to the washing tub. That is, the net filter is not easily separated from or coupled to the washing tub, and foreign materials fall down during the process thus to make the user's hand dirty.

Second, since the net filter is installed at an upper end of the washing tub, when a certain amount of water and a water pressure more than a certain level are not maintained, washing water can not be supplied to the net filter. Accordingly, foreign materials can not be filtered by the net filter.

Third, the net filter is installed to be exposed to inside of the washing tub, thus to repeatedly come in contact with laundry to be easily abraded, etc. Accordingly, the net filter may be easily damaged thus to have a short lifespan.

Fourth, the net filter is installed to be long disposed inside the washing tub, thereby degrading the appearance.

SUMMARY OF THE INVENTION

Therefore, it is one object of the present invention to provide a foreign materials filtering apparatus capable of being easily detachably mounted at a washing water circulating duct.

It is another object of the present invention to provide a foreign materials filtering apparatus capable of having a long lifespan in spite of repeatedly coming in contact with laundry.

It is still another object of the present invention to provide a foreign materials filtering apparatus capable of filtering foreign materials without a certain amount of water and a water pressure more than a certain level.

It is yet still another object of the present invention to provide a foreign materials filtering apparatus capable of enhancing the appearance when being installed at a washing tub.

It is further yet still another object of the present invention to provide a washing machine having the foreign materials filtering apparatus.

To achieve these and other advantages and in accordance with the purpose of the present invention, as embodied and broadly described herein, there is provided a foreign materials filtering apparatus detachably mounted at a washing water circulating duct that circulates washing water, comprising: a filter cover unit; and a filter unit integrally modularized with the filter cover unit.

Preferably, the filter cover unit comprises a cap, and a handle installed at the cap. Preferably, a plurality of drain holes are formed at the cap.

Preferably, the filter unit comprises a front filter installed at a rear side of the cap, and a rear filter installed at a rear side of the front filter. Preferably, a mesh or a mesh hole is installed at the front filter, and the mesh is installed at the mesh hole.

Preferably, the rear filter is provided with a protrusion backward protruding, and a foreign materials filtering space is formed between the front filter and the rear filter.

To achieve these and other advantages and in accordance with the purpose of the present invention, as embodied and broadly described herein, there is also provided a washing machine, comprising: a cabinet; a reservoir received in the cabinet, for containing washing water therein; a washing tub rotatably received in the reservoir; a pulsator received in the washing tub, for stirring laundry; a washing water circulating duct that forms a flow passage through which washing water circulates as the pulsator rotates; and a foreign materials filtering apparatus detachably mounted at the washing water circulating duct, and having a filter cover unit and a filter unit integrally modularized with each other.

Preferably, the filter cover unit comprises a cap, and a handle inserted into the cap. Preferably, hooks to be coupled to the washing water circulating duct are formed at the handle, and hook coupling grooves for coupling the hooks are formed at the washing water circulating duct.

Preferably, the filter unit comprises a front filter installed at a rear side of the cap, and a rear filter installed at a rear side of the front filter. Preferably, the rear filter is provided with a protrusion backward protruding, and a filter insertion hole for inserting the protrusion is formed at the washing water circulating duct. Preferably, a guide protrusion for covering the cap is protrudingly formed at the periphery of the filter insertion hole.

Preferably the foreign materials filtering apparatus is installed at an intermediate height of the washing tub.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
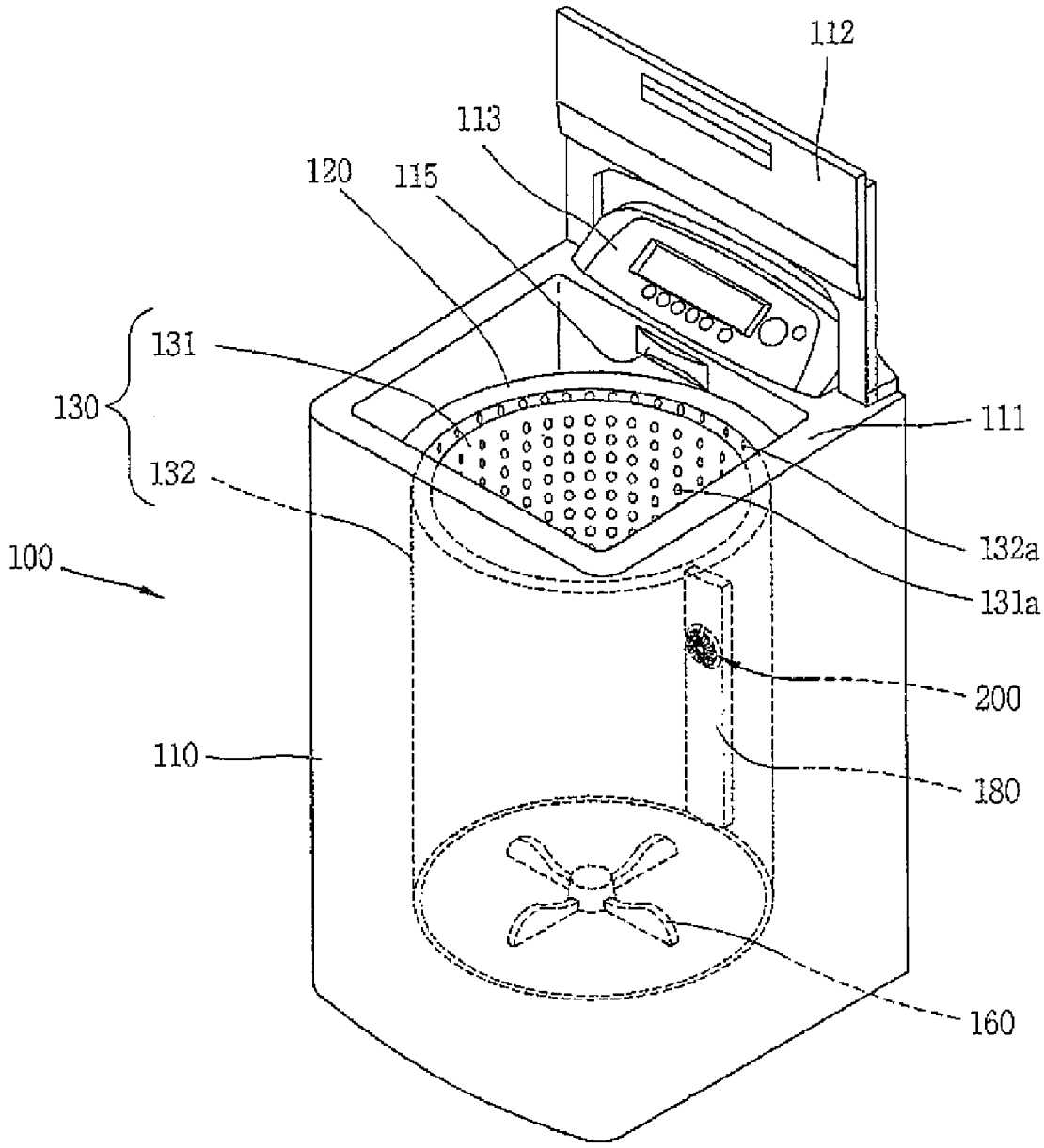
FIG. 1 is a perspective view of a washing machine having a foreign materials filtering apparatus according to a first embodiment of the present invention.
Figure 2:
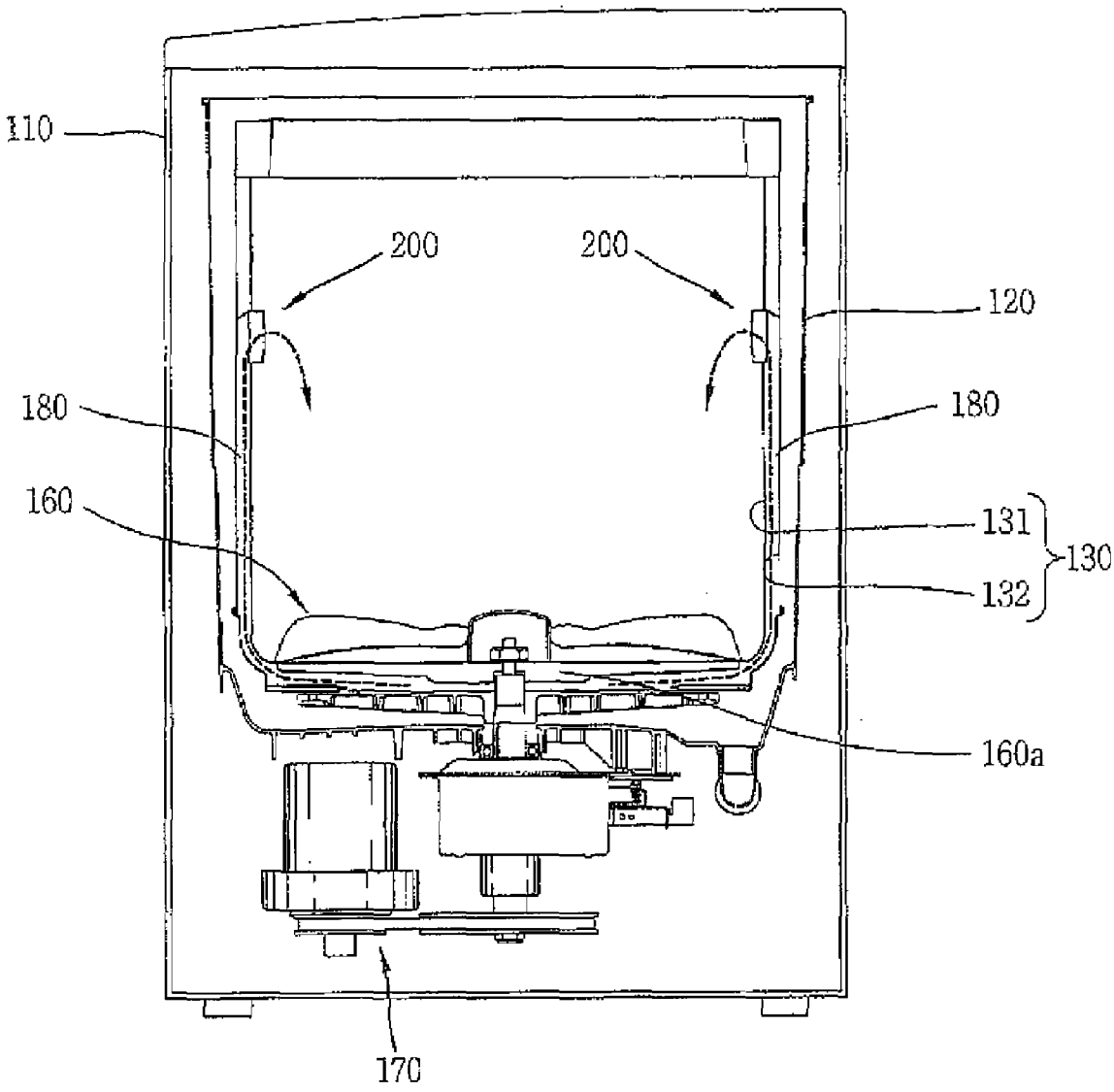
FIG. 2 is a side sectional view of the washing machine of FIG. 1.
Figure 3:
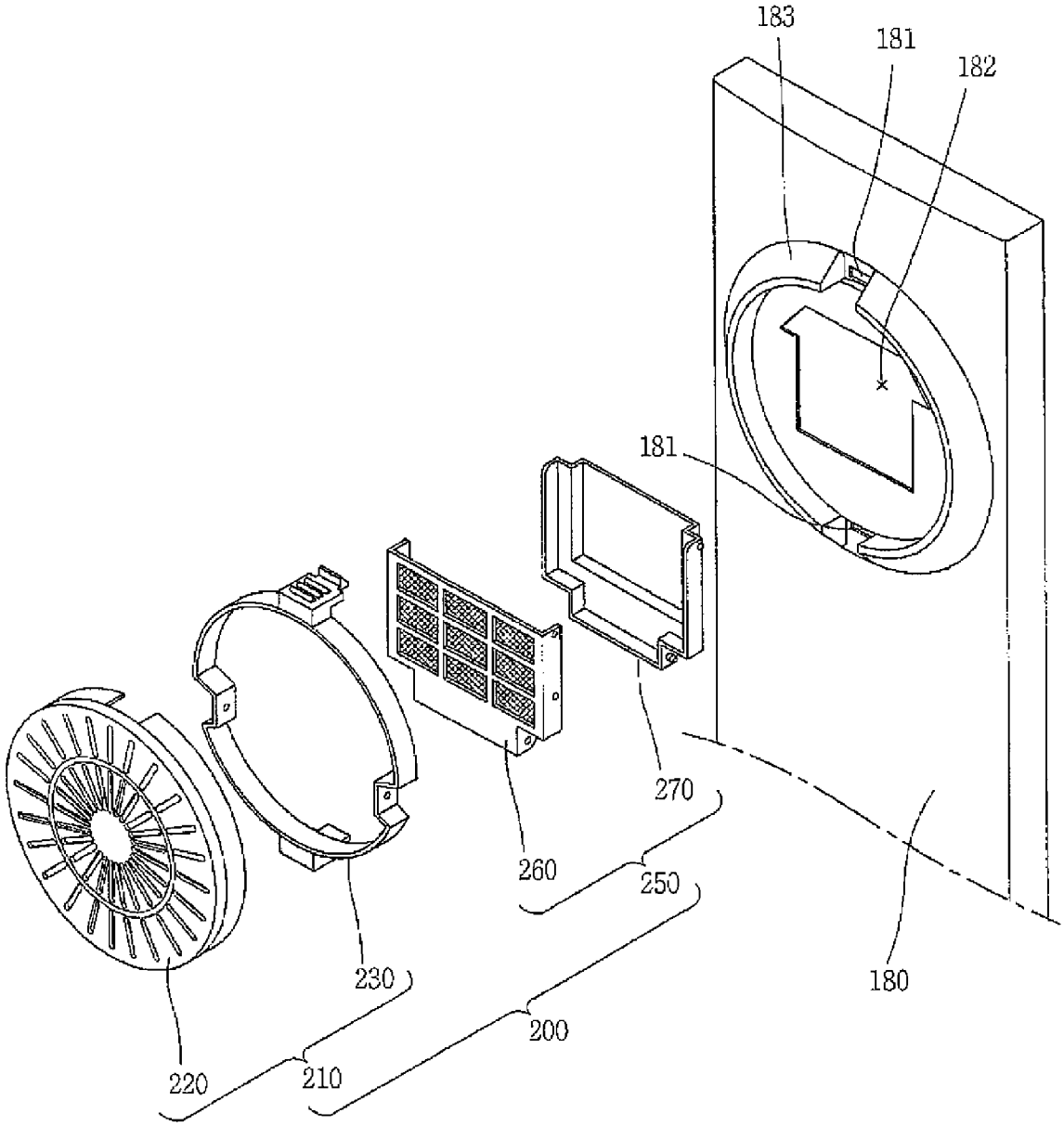
FIG. 3 is an exploded perspective view of the foreign materials filtering apparatus of FIG. 1.
Figure 4:
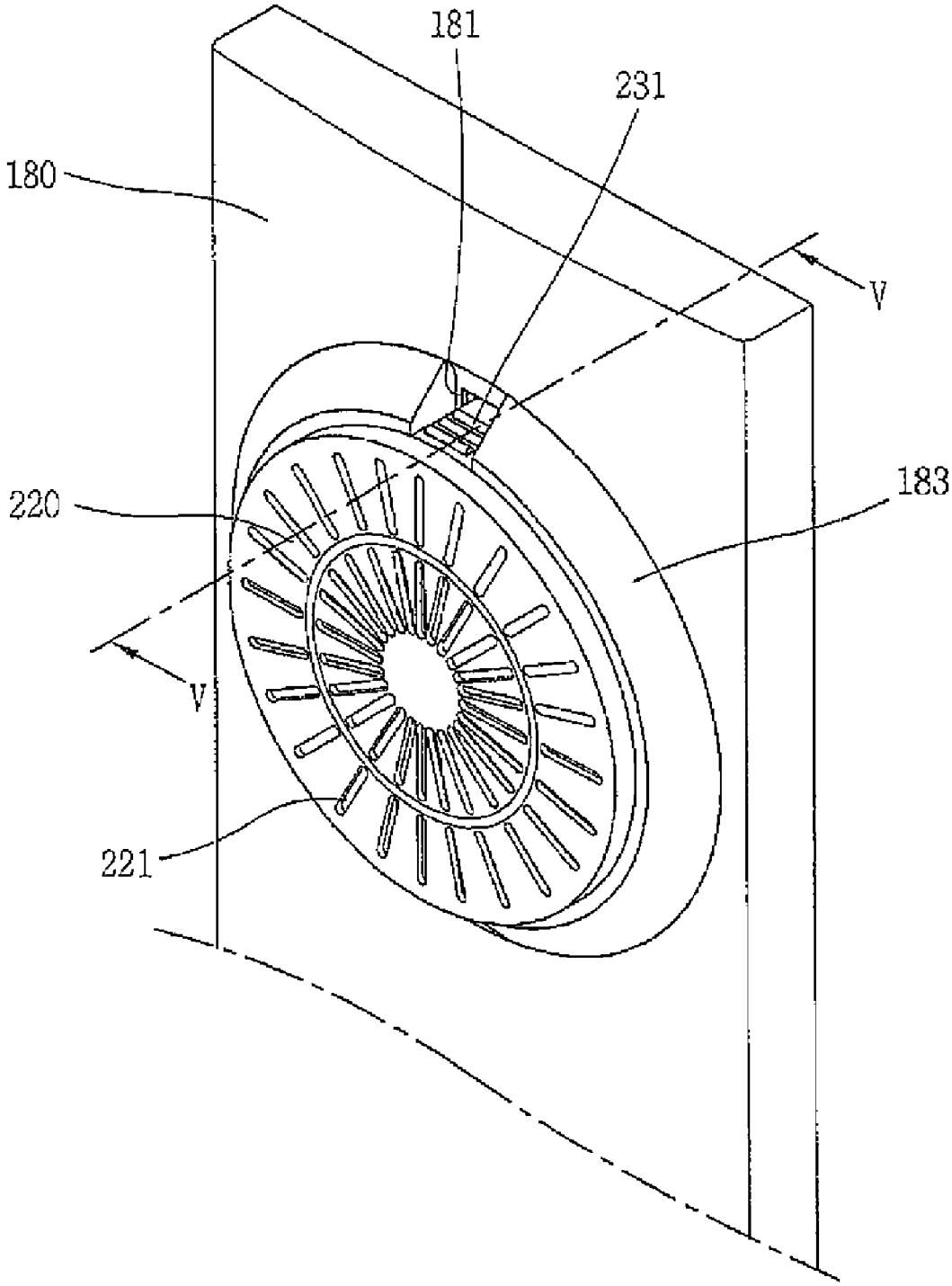
FIG. 4 is a perspective view showing a state that the foreign materials filtering apparatus of FIG. 1 is detachably mounted at a washing water circulating duct.
Figure 5:
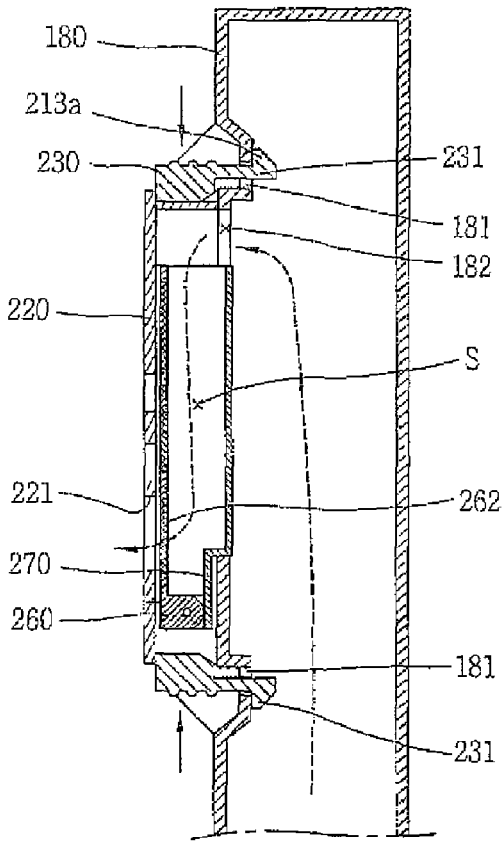
FIG. 5 is a sectional view taken along line 'V-V' of FIG. 4.
Figure 6:
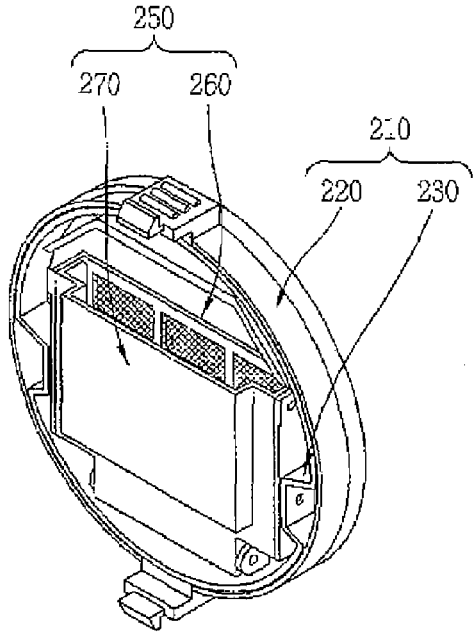
FIG. 6 is a disassembled rear view of the foreign materials filtering apparatus of FIG. 4.
Figure 7:
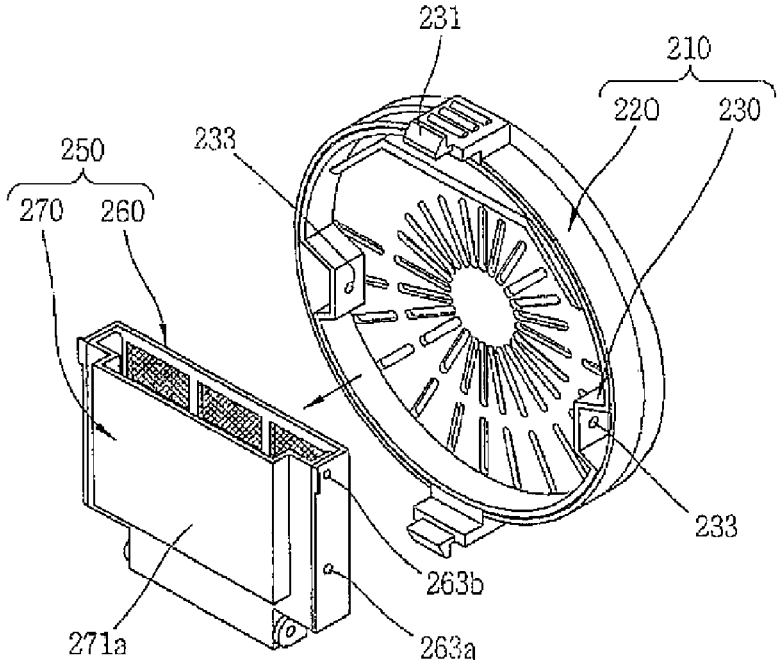
FIG. 7 is a view showing a state that a filter cover unit and a filter unit of FIG. 6 are separated from each other.
Figure 8:
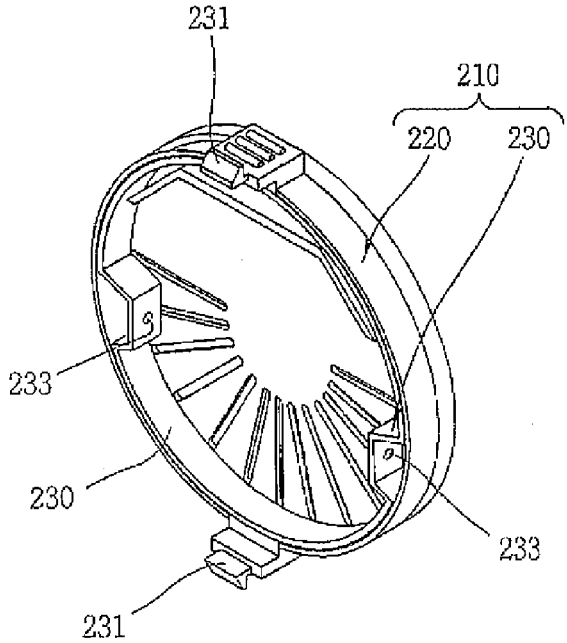
FIG. 8 is a view of the filter cover unit of FIG. 7.
Figure 9:
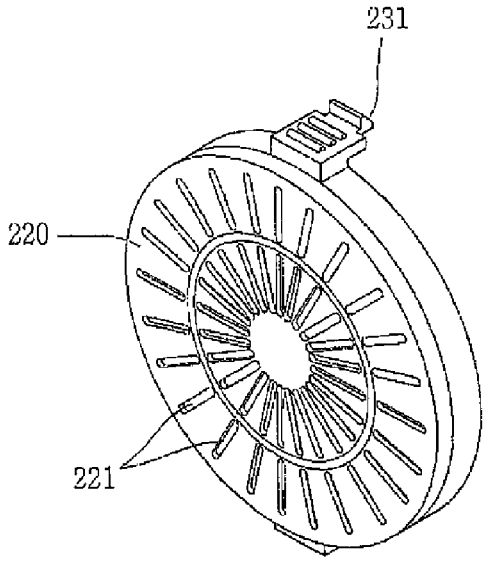
FIG. 9 is a perspective view of a cap of FIG. 8.
Figure 10:
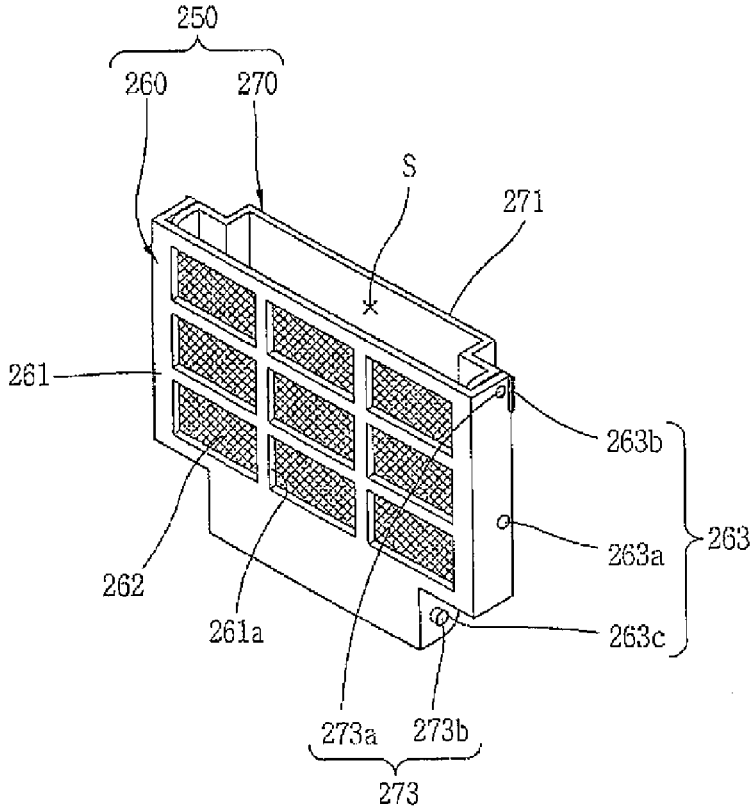
FIG. 10 is a view of the filter unit of FIG. 7.
Figure 11:
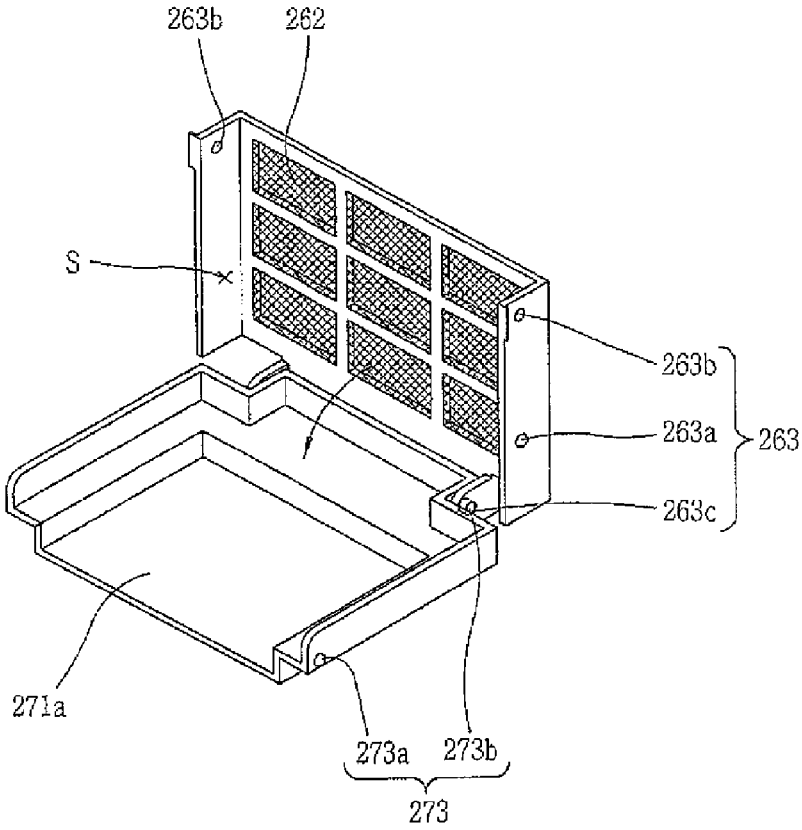
FIG. 11 is a view showing a state that a rear filter of FIG. 10 is backward opened.
Figure 12:
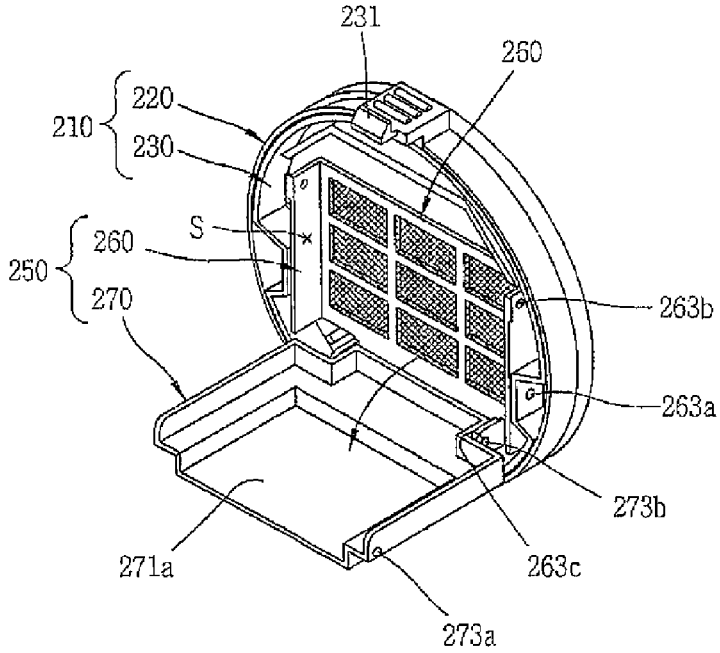
FIG. 12 is a view showing a state that a rear filter of FIG. 6 is backward opened.

FIG. 1 is a perspective view of a washing machine having a foreign materials filtering apparatus according to a first embodiment of the present invention; FIG. 2 is a side sectional view of the washing machine of FIG. 1; FIG. 3 is an exploded perspective view of the foreign materials filtering apparatus of FIG. 1; FIG. 4 is a perspective view showing a state that the foreign materials filtering apparatus of FIG. 1 is detachably mounted at a washing water circulating duct; FIG. 5 is a sectional view taken along line 'V-V' of FIG. 4; FIG. 6 is a disassembled rear view of the foreign materials filtering apparatus of FIG. 4; FIG. 7 is a view showing a state that a filter cover unit and a filter unit of FIG. 6 are separated from each other; FIG. 8 is a view of the filter cover unit of FIG. 7; FIG. 9 is a perspective view of a cap of FIG. 8; FIG. 10 is a view of the filter unit of FIG. 7; FIG. 11 is a view showing a state that a rear filter of FIG. 10 is backward opened; and FIG. 12 is a view showing a state that a rear filter of FIG. 6 is backward opened. Here, the dotted arrow indicates washing water flowing in a washing water circulating duct.

Referring to FIGS. 1 and 2, a washing machine 100 having a foreign materials filtering apparatus according to a first embodiment of the present invention comprises: a cabinet 110 that forms the appearance; a reservoir 120 received in the cabinet 110, for containing washing water therein; a washing tub 130 rotatably received in the reservoir 120, and consisting of an outer wall 132 and an inner wall 131; a pulsator 160 rotatably installed on a bottom surface of the inner wall 131, for stirring laundry; a driving unit 170 for simultaneously or individually driving the washing tub 130 and the pulsator 160; a washing water circulating duct 180 that forms a flow passage through which washing water rises toward an upper side of the washing tub 130 as the pulsator 160 rotates; and a foreign materials filtering apparatus 200 detachably mounted on the washing water circulating duct 180.

A top cover 111 is mounted at an upper portion of the cabinet 110. A lid 112 for opening and closing the washing tub 130 is installed at an upper portion of the top cover 111. A control panel 113 for controlling an operation of the washing machine 100 is installed at one side of the top cover 111, and a detergent box 115 is insertion-installed at an inner side of the top cover 111.

The washing tub 130 is composed of an outer wall 132 that forms the appearance, and an inner wall 131 spacing from the outer wall 132 with a certain gap and having a receiving space to receive laundry therein.

A plurality of drain holes 132*a* and 131*a* are penetratingly formed at the outer wall 132 and the inner wall 131, through which washing water inside the reservoir 120 flows in/out of the washing tub 130.

Referring to FIGS. 2 and 3, the washing water circulating duct 180 is formed between the outer wall 132 and the inner wall 131, and circulates washing water by guiding washing water collected below the pulsator 160 to an upper side of the washing tub 130 and then by flowing to the washing tub 130. A filter insertion hole 182 for mounting the foreign materials filtering apparatus 200 is formed at an intermediate portion of the washing water circulating duct 180. A guide protrusion 183 for covering a cap 220 of the foreign materials filtering apparatus 200 is protrudingly formed at the periphery of the filter insertion hole 182. Owing to the guide protrusion 183, the foreign materials filtering apparatus 200 can be stably mounted at a precise position of the washing water circulating duct 180. Since the foreign materials filtering apparatus 200 is installed at an intermediate height of the washing tub 130, can be solved the conventional problem that washing water is not supplied to a net filter installed at an upper end of a washing tub thus not to filter foreign materials unless a certain amount of water and a water pressure of a certain level are maintained.

Referring to FIGS. 4 and 5, the foreign materials filtering apparatus 200 is detachably mounted at the washing water circulating duct 180.

Referring to FIGS. 6 and 7, the foreign materials filtering apparatus 200 includes a filter cover unit 210, and a filter unit 250 integrally modularized with the filter cover unit 210. Accordingly, once the filter cover unit 210 is separated from the washing water circulating duct 180 by a user, the filter unit 250 is also separated from the washing water circulating duct 180. Likewise, once the filter cover unit 210 is coupled to the washing water circulating duct 180 by a users the filter unit 250 is also coupled to the washing water circulating duct 180. Accordingly, a user can easily detachably mount the filter unit 250 to the washing water circulating duct 180.

Referring to FIGS. 8 and 9, the filter cover unit 210 includes a cap 220, and a handle 230 inserted into the cap 220. The cap 220 and the handle 230 may be integrally formed with each other. However, the handle 230 individually formed from the cap 220 may be inserted into the cap 220.

The cap 220 is a round-shaped lid, and is provided with a plurality of drain holes 221 radially arranged at a front lower end thereof. Through the drain holes 221, washing water having foreign materials removed therefrom is discharged to the washing tub 130. Preferably, the cap 220 is formed of PC material hard enough to resist an impact with laundry.

Since the cap 220 is formed of a hard material, can be solved the conventional problem that a net filter is exposed to inside of a washing tub thus to be easily abraded by repeatedly coming in contact with laundry, etc., thus to have a short life span.

Additionally, can be solved the conventional problem that a net filter is long disposed in a washing tub thus to degrade the appearance.

The handle 230 has a ring shape of which central part inserted into the cap 220 is hollow. Hooks 231 to be coupled to hook coupling holes 181 of the washing water circulating duct 180 are formed at upper and lower portions of the handle 230. Coupling holes 233 for inserting coupling protrusions 263*a* of a front filter 260 are formed at both side surfaces of the handle 230. Preferably, the handle 230 is formed of a POM material having a flexible property so as to be detachably mounted at the washing water circulating duct 180. As a user separates the hooks 231 of the handle 230 from the hook coupling holes 181 with pressing the hooks 231 at both sides, the foreign materials filtering apparatus 200 is separated from the washing water circulating duct 180. Since the hooks 231 are detachably mounted at the hook coupling hole 181, the foreign materials filtering apparatus 200 can be easily detachably mounted at the washing water circulating duct 180.

Referring to FIGS. 10 and 11, the filter unit 250 includes a front filter installed at a rear side of the cap 220, and a rear filter 270 installed at a rear side of the front filter 260. As the front and rear filters 260 and 270 are coupled to each other, a foreign materials filtering space (S) is formed.

The front filter 260 includes a frame 261, and a coupling portion 263 detachably coupled to the handle 230 of the frame 261 and the rear filter 270.

A mesh 262 is formed at a front surface of the frame 261, thereby filtering foreign materials included in washing water. The mesh 262 may be directly formed on the front surface of the frame 261 in an injection manner. As shown in the preferred embodiment, the mesh 262 may be formed by forming mesh mounting holes 261*a* on the front surface of the frame 261 and then by inserting a wire mesh into the mesh mounting holes 261*a*.

The coupling portion 263 consists of coupling protrusions 263*a* formed at each middle part of both side surfaces of the frame 261, coupling holes 263*b* formed at each upper end of both side surfaces of the frame 261, and hinge holes 263*c* formed at each lower end of both side surfaces of the frame 261.

The coupling protrusions 263*a* are inserted into coupling holes 233 (refer to FIG. 9) of the handle 230. Preferably, the coupling protrusions 263*a* are protruding with a height high enough to be easily detachably mounted to the coupling holes 233. It is also possible that the coupling protrusions 263*a* are formed at the handle 230, and the coupling holes 233 are formed at the frame 261. As the coupling protrusions 263*a* are detachably mounted at the coupling holes 233, the front filter 260 can be easily detachably mounted at the handle 230.

Coupling protrusions 273*a* of the rear filter 270 are inserted into the coupling holes 263*b*, and hinges 273*b* of the rear filter 270 are inserted into the hinge holes 263*c*.

The rear filter 270 includes a frame 271, and a coupling portion 273 formed at the frame 271 and for coupling the rear filter 270 to the front filter 260.

The rear filter 271 is provided with a protrusion 271*a* backward protruding, thereby being inserted into a filter insertion hole 182 of the washing water circulating duct 180. Due to the protrusion 271*a*, a foreign materials filtering space (S) formed as the front and rear filters 260 and 270 are coupled to each other has a large volume. Accordingly, a larger amount of foreign materials can be collected in the foreign materials filtering space (S), thereby reducing the number of times a user removes the foreign materials.

The coupling portion 273 consists of coupling protrusions 273*a* formed at both side surfaces of the frame 271, and hinges 273*b* for rotating the frame 271 with respect to the front filter 260.

The coupling protrusions 273*a* are inserted into the coupling holes 263*b* of the front filter 260. Preferably, the coupling protrusions 273*a* are protruding with a height high enough to be easily detachably mounted to the coupling holes 263*b*. It is also possible that the coupling protrusions 273*a* are formed at the front filter 260, and the coupling holes 263*b* are formed at the rear filter 270. Owing to the detachable mounting structure between the coupling protrusions 273*a* and the coupling holes 263*b*, the rear filter 270 can be easily detachably mounted at the front filter 260.

The hinges 273*b* are inserted into the hinge holes 263*c* of the front filter 260. It is also possible that the hinges 273*b* are formed at the front filter 260, and the hinge holes 263*c* are formed at the rear filter 270.

Referring to FIGS. 5 and 12, a process for removing foreign materials collected in the foreign materials filtering space (S) will be explained.

First, the foreign materials filtering apparatus 200 is separated from the washing water circulating duct 180 under a state that the hooks 231 of the handle 230 are pressed in two directions indicated by the arrows. Then, the rear filter 270 is backward pulled so as to rotate centering around the hinges 273*b* in a direction of the arrow. Here, the coupling protrusions 273*a* of the rear filter 270 rotate centering around the hinges 263*c* while being separated from the coupling holes 263*b* of the front filter 260, thereby backward opening the foreign materials filtering space (S). Then, a user removes foreign materials collected in the foreign materials filtering space (S).

Hereinafter, the operation of the washing machine having a foreign materials filtering apparatus according to a first embodiment of the present invention will be explained.

Referring to FIGS. 1 and 2, when laundry is deposited in the washing tub 130, power is supplied and washing conditions are inputted from the control panel 113. Once a washing operation starts by pressing a starting button, washing water is supplied to the reservoir 120. Then, the washing water is introduced into the washing tub 130 through the drain holes 132*a* of the outer wall 132 and the drain holes 131*a* of the inner wall 131.

When the washing water reaches a certain level of the washing tub 130, the washing tub 130 and the pulsator 160 rotates thus to starts a washing operation. Accordingly, laundry is entangled, and the washing water is moved toward the inner wall 131 of the washing tub 130 thus to perform a circular motion along the inner wall 131.

As the pulsator 160 and the washing tub 130 rotate in directions changed with a certain time interval, laundry is entangled to be washed.

Washing water collected below the pulsator 160 is introduced to an upper side of the washing tub 130 through the washing water circulating duct 180 by a lower flange 160*a* of the pulsator 160 in a direction of the arrow. The risen washing water passes through the foreign materials filtering apparatus 200 installed at the washing water circulating duct 180. Here, foreign materials included in the washing water are filtered, and the washing water having foreign materials removed therefrom is discharged to the washing tub 130 through the foreign materials filtering apparatus 200.

A process for filtering foreign materials by the foreign materials filtering apparatus 200 will be explained in more detail. Referring to FIG. 5, washing water is introduced into the foreign materials filtering space (S) through an upper portion of the filter insertion hole 182 that is not blocked by the protrusion 271*a* of the rear filter 270. Then, the washing water passes through the mesh 262 installed on a front surface of the front filter 260, and foreign materials included in the washing water are filtered by the mesh 262 thus to be collected in the foreign materials filtering space (S). The washing water having passed through the mesh 262 is discharged to the washing tub 130 (refer to FIG. 2) through the drain holes 221 of the cap 220.

The foreign materials filtering apparatus and the washing machine having the same according to a first embodiment of the present invention will be explained.

First, since the filter cover unit and the filter unit are integrally modularized with each other, a user can separate or mount the filter unit from/to the washing water circulating duct by separating or mounting the filter cover unit from/to the washing water circulating duct. Accordingly, the foreign materials filtering apparatus can be easily detachably mounted at the washing water circulating duct.

Since the foreign materials filtering apparatus is installed at an intermediate height of the washing tub, can be solved the conventional problem that washing water is not supplied to a net filter installed at an upper end of a washing tub thus not to filter foreign materials unless a certain amount of water and a water pressure of a certain level are maintained. Accordingly, a foreign materials filtering function by the foreign materials filtering apparatus is enhanced.

Since the filter unit is covered by the cap, can be solved the conventional problem that a net filter is exposed to inside of a washing tub thus to be easily abraded by repeatedly coming in contact with laundry, etc., thus to have a short life span. Accordingly, an endurance characteristic of the foreign materials filtering apparatus is enhanced. Also, can be solved the conventional problem that a net filter is long disposed in a washing tub thus to degrade the appearance.

Fourth, since the protrusion of the front filter is inserted into the filter insertion hole of the washing water circulating duct, the foreign materials filtering space has a large volume. Accordingly, a larger amount of foreign materials can be collected in the foreign materials filtering space, thereby reducing the number of times a user removes the foreign materials.

Fifth, since the guide protrusion for covering the foreign materials filtering apparatus is protrudingly formed at the periphery of the filter insertion hole of the washing water circulating duct, the foreign materials filtering apparatus can be stably mounted at a precise position of the washing water circulating duct.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A foreign materials filtering apparatus detachably mounted at a filter insertion hole in a washing water circulating duct that circulates washing water, comprising:

a filter cover unit having a cap and a handle installed at the cap; and a filter unit integrally modularized with the filter cover unit, and comprising a front filter installed at a rear side of the cap, a rear filter installed at a rear side of the front filter, and a foreign materials filtering space formed between the front filter and the rear filter, wherein the height of the rear filter is less than that of the opening of the filter insertion hole.

2. The apparatus of claim 1, wherein a plurality of drain holes are formed at the cap.

3. The apparatus of claim 1, wherein a mesh is formed at the front filter.

4. The apparatus of claim 1, wherein a mesh hole is installed at the front filter, and a mesh is installed at the mesh hole.

5. The apparatus of claim 1, wherein the rear filter is provided with a protrusion backward protruding.

6. A washing machine having the foreign materials filtering apparatus of claim 1.

7. The apparatus of claim 1, wherein the cap has a front wall and a side wall extending from the front wall, the front filter releasable retained to an inner surface of the cap side wall.

8. A washing machine, comprising:

a cabinet;

a reservoir received in the cabinet, for containing washing water therein;

a washing tub rotatably received in the reservoir;

a pulsator received in the washing tub, for stirring laundry;

a washing water circulating duct that forms a flow passage through which washing water circulates as the pulsator rotates and comprising a filter insertion hole; and a foreign materials filtering apparatus detachably mounted at the washing water circulating duct, and having a filter cover unit and a filter unit integrally modularized with each other, wherein the filter cover unit comprises a cap and a handle inserted into the cap, wherein the filter unit comprises a front filter installed at a rear side of the cap, a rear filter installed at a rear side of the front filter, and a foreign materials filtering space formed between the front filter and the rear filter, and wherein the opening of the filter insertion hole has a greater height than the height of the rear filter.

9. The washing machine of claim 8, wherein hooks to be coupled to the washing water circulating duct are formed at the handle, and hook coupling grooves for coupling the hooks are formed at the washing water circulating duct.

10. The washing machine of claim 8, wherein the rear filter is provided with a protrusion backward protruding, and a filter insertion hole for inserting the protrusion is formed at the washing water circulating duct.

11. The washing machine of claim 10, wherein a guide protrusion for covering the cap is protrudingly formed at the periphery of the filter insertion hole.

12. The washing machine of claim 8, wherein the foreign materials filtering apparatus is installed at an intermediate height of the washing tub.

13. The washing machine of claim 8, wherein the cap has a front wall and a side wall extending from the front wall, the front filter releasable retained to an inner surface of the cap side wall.

14. The washing machine of claim 8, wherein the rear filter is flush with a wall of the washing water circulating duct.

* * * * *